United States Patent [19]

Matsuda

[11] 4,409,802

[45] Oct. 18, 1983

[54] WARP-KNIT STRINGER TAPE FOR SLIDE FASTENERS

[75] Inventor: Yoshio Matsuda, Nyuzen, Japan

[73] Assignee: Yoshida Kogyo K.K., Tokyo, Japan

[21] Appl. No.: 328,953

[22] Filed: Dec. 9, 1981

[30] Foreign Application Priority Data

Dec. 16, 1980 [JP] Japan ..... 55-180519[U]

[51] Int. Cl.[3] ..... D04B 23/08

[52] U.S. Cl. ..... 66/193; 66/195; 24/205.16 R

[58] Field of Search ..... 66/190–195, 66/202; 24/216.15 C

[56] References Cited

U.S. PATENT DOCUMENTS

| | | | |
|---|---|---|---|
| 3,974,549 | 8/1976 | Matsuda | 66/195 |
| 3,974,550 | 8/1976 | Fujisaki et al. | 66/195 |
| 3,983,721 | 10/1975 | Matsuda | 66/195 |
| 4,015,450 | 4/1977 | Matsuda et al. | 66/195 |
| 4,041,577 | 8/1977 | Matsuda | 66/195 |
| 4,047,402 | 9/1977 | Matsuda et al. | 66/195 |
| 4,074,398 | 2/1978 | Matsuda et al. | 66/195 |
| 4,142,276 | 3/1979 | Heimberger | 66/190 |
| 4,279,134 | 7/1981 | Matsuda | 66/195 |

*Primary Examiner*—Ronald Feldbaum

*Attorney, Agent, or Firm*—Hill, Van Santen, Steadman & Simpson

[57] ABSTRACT

A wrap-knit stringer tape for slide fastener comprising a warp-knit structure including a coarse region extending longitudinally therethrough within a portion other than a coupling element-supporting marginal edge portion, said coarse region being devoid of at least one of the threads which are knit in a wale-forming stitch pattern and each interconnecting two adjacent wales.

7 Claims, 5 Drawing Figures

WARP-KNIT STRINGER TAPE FOR SLIDE FASTENERS

BACKGROUND OF THE INVENTION

1. Field of the Invention

The present invention relates to a warp-knit stringer tape for slide fasteners which is suitable for the attachment to the fabric of a knit garment on a knitting machine or a linking machine.

2. Prior Art

There have been proposed slide fasteners which have a pair of warp-knit stringer tapes each including a pair of warp-knit stringer tapes each tape including a pair of laterally spaced elongate webs with a longitudinal wale-free coarse region interposed therebetween, the webs being interconnected by a connecting thread. The connecting thread has portions laid in opposed marginal wales in the webs, and substantially parallel portions extending transversely across the wale-free coarse region, thereby providing a plurality of substantially rectangular openings longitudinally in and along the wale-free coarse region. The proposed slide fasteners are connected to knit garments on a knitting machine or a linking machine with chains of thread loops running along the wale-free coarse regions in the respective tapes. The coarse region is devoid of one or two wales and hence the openings formed therein have a rectangular shape extending in the coursewise direction, allowing the stringer tapes as attached to the knit garment to displace or wobble with respect to the thread loops, particularly in the transverse direction of the tapes. When the knit garment with the slide fastener closed is subjected to a lateral pull, the parallel transverse portions of the connecting threads are pulled outwardly of the general plane of the tapes via the thread loops. As a result, outer longitudinal edge portions of the respective stringer tapes are turned up away from the the general plane of the knit garment, making the slide fastener, hence and the knit garment, unsightly.

SUMMARY OF THE INVENTION

A slide fastener stringer tape has a warp-knit structure including an element-supporting edge portion and comprising a plurality of first threads knit as chain stitches and each forming one wale, a plurality of second threads knit in a stitch pattern forming wales and each interconnecting two adjacent wales, and a plurality of third threads each extending coursewise across at least three wales and interconnecting said at least three wales. The warp-knit structure further includes a coarse region within portions other than said element-supporting edge portion, the coarse region being devoid of at least one of the second threads. The stringer tape with the coarse region can be mounted stably on the fabric of a knit garment with a chain of thread loops snugly received in and along the coarse region.

It is an object of the present invention to provide a warp-knit stringer tape which can be attached neatly onto the fabric of a knit garment on a knitting machine or a linking machine.

Another object of the present invention is to provide a warp-knit stringer tape including a longitudinal coarse region which is receptive of a chain of thread loops snugly therein for stable attachment of a slide fastener to a knit garment.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
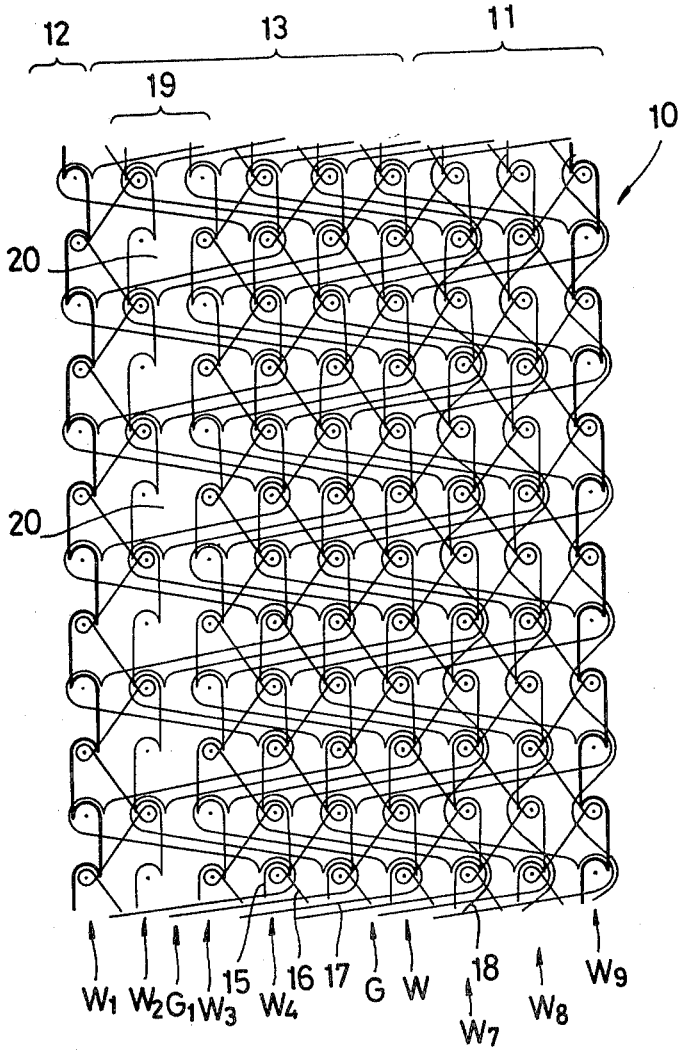
FIGS. 1 to 4 are point diagrams showing, respectively, lapping movements for warp-knit stringer tapes of various embodiments provided in accordance with the present invention.
Figure 5:
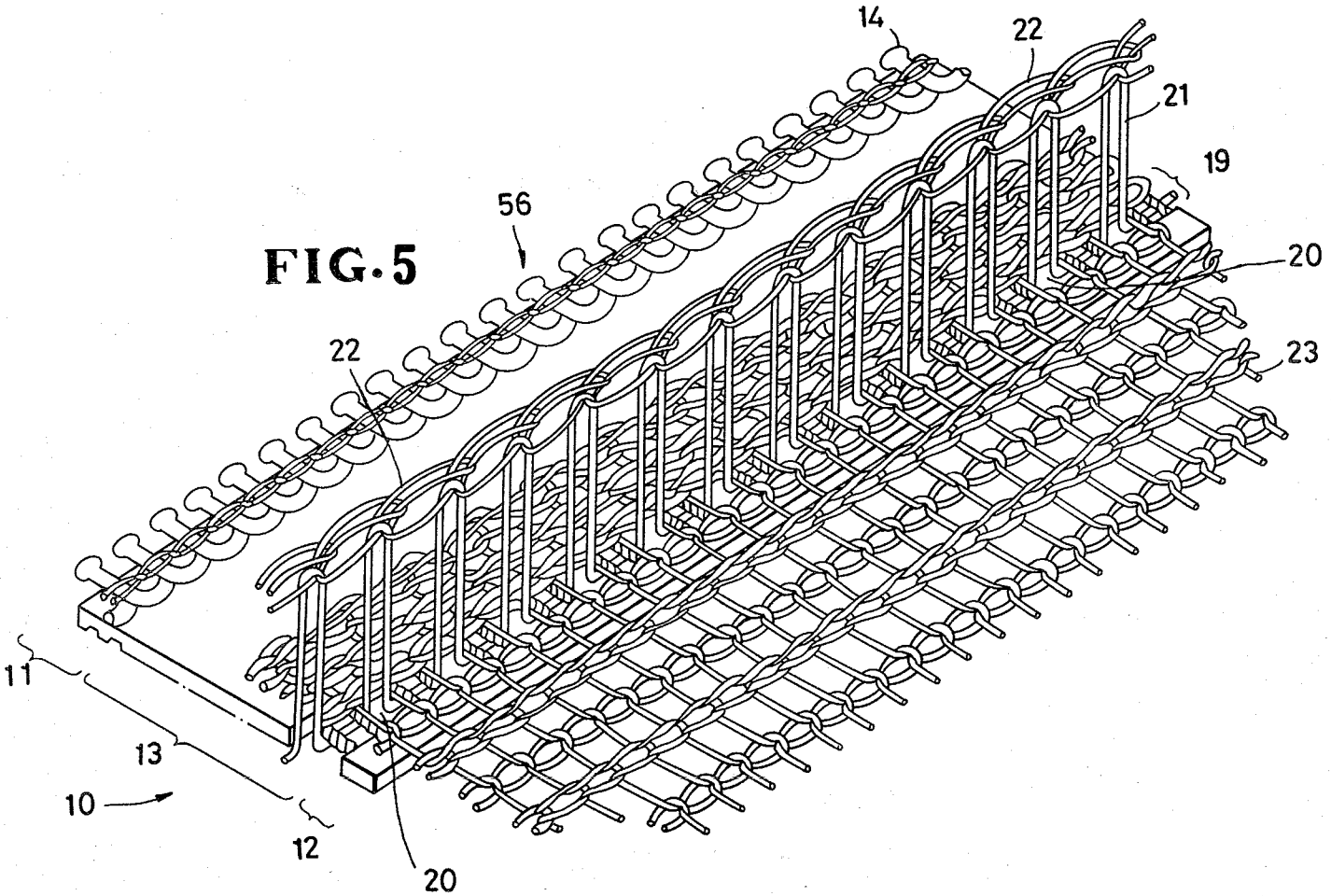
FIG. 5 is an enlarged fragmentary perspective view of a slide fastener stringer including the warp-knit stringer tape shown in FIG. 1, as attached to a knit fabric with a chain of thread loops.

The principles of the present invention are particularly useful when embodied in a warp-knit stringer tape such as shown in FIGS. 1 and 5, generally indicated by the reference numeral 10.

The warp-knit stringer tape 10 comprises a warp-knit structure including along a pair of opposite longitudinal edge thereof a pair of spaced longitudinal edge portions 11,12, respectively, and a central web portion 13 extending between the edge portions 11,12, one of the edge portions 11 being adapted to support a row of coupling elements 14 (FIG. 5). The warp-knit structure comprises a plurality of first threads 15 knit as chain stitches in a pattern of 1-0/0-1, a plurality of second threads 16 knit as tricot stitches in a pattern of 1-2/1-0, and a plurality of third threads 17 knit as single cord stitches in a pattern of 0-1/4-3, the threads 15,16,17 thus knit constituting a plurality of longitudinal wales W juxtaposed across the warp-knit structure. Each second thread 16 extends across two adjacent wales and interconnects the two wales. Each of the third threads 17 extends coarsewise across four wales or three interwale grooves G and interconnects the four wales.

Additionally included in the one edge portion or element-supporting edge portion 11 is a plurality of fourth threads 18 (three in the illustrated embodiment) laid in a pattern of 0-0/1-1 and extending in and along three of the wales $W_7$,$W_8$,$W_9$ so as to reinforce the edge portion 11. The other edge portion 12 includes a single, first or outermost wale $W_1$. The chain stitches 15 located along the edges of the stringer tape 10 are made of threads thicker than those of other chain stitches to reinforce the first wale $W_1$ and the ninth wale $W_9$ along the edge of the tape 10. However, the chain stitches 15 in the wales $W_1$,$W_9$ may be made of a plurality of parallel yarns each having the same thickness as that of the chain stitches in other wales. The second threads 16 may be knit as two-needle stitches.

In the central web portion 13, a second inner successive wale $W_2$ lying adjacent to the first wale $W_1$ in the edge portion 12 and a third inner successive wale $W_3$ are devoid of the second thread or tricot stitch 16 which has needle loops formed in the wales $W_2$,$W_3$ and shinker loops extending across an interwale groove $G_1$ between the wales $W_2$,$W_3$. Due to the absence of the tricot stitch 16, the wales $W_2$,$W_3$ are smaller than other wales $W_1$ and $W_4$ to $W_9$, and a coarse region 19 is formed in the central web portion 13 and which extends longitudinally through the central web portion 13 adjacent to the other edge portion 12.

Of the wales $W_2$,$W_3$ in the coarse region 19, the second wale $W_2$ is stable positionally and is kept in its normal position by the tension of the tricot stitch 16 and the single cord stitch 17 pulling the wale $W_2$ in opposite directions. Under the tension of the tricot and single cord stitches 16,17, the wale $W_3$ is pulled toward the fourth wale $W_4$ so that the interwale groove $G_1$, is widened as compared with other interwale grooves G. As a result, a plurality of openings 20 is formed in the coarse region 19 which openings extend longitudinally in the widened interwale $G_1$ between the webs $W_3$,$W_4$. Each opening 20 thus formed is of a size small enough to receive snugly therein one interstitch 21 between two adjacent loops of a thread loop chain 22 (FIG. 5) with which the warp-knit stringer tape 10 is connected to the fabric of a knit garment 23 (FIG. 5).

The warp-knit stringer tape 10 as attached to the knit fabric 23 on a knitting machine or a linking machine (not shown) is fully prevented from displacing laterally with respect to the chain of thread loop 22, and hence is free from turning up at the other edge portion 12 thereof. The openings 20 in the coarse region 19 are well receptive of the needles on a knitting machine or a linking machine and serve as a standard for positioning the stringer tape 10 with respect to the knit garment 23.

Figure 2:
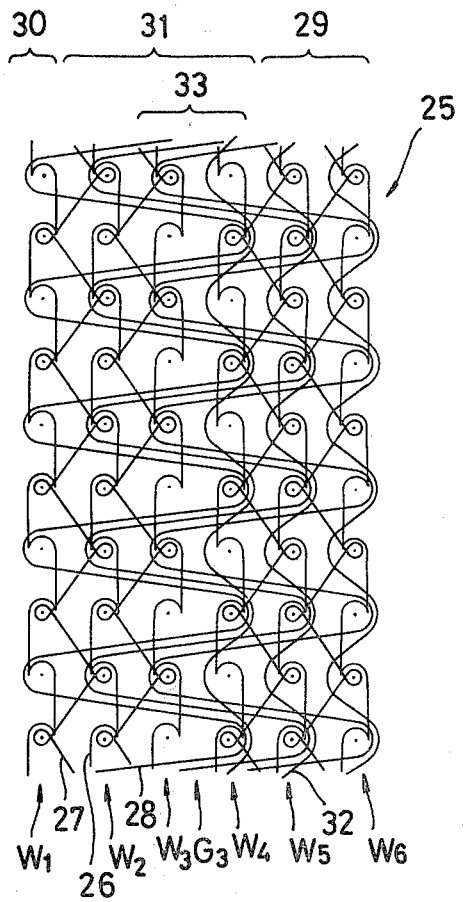

A stringer tape 25 of a second embodiment shown in FIG. 2 is of a warp-knit structure which is narrower than that of FIG. 1. The warp-knit structure is composed of chain stitches 26 knit in a pattern of 1-0/0-1, tricot stitches 27 knit in a pattern of 1-2/1-0, and weft threads 28 laid in a pattern of 0-0/4-4, the chain stitches 26 and the tricot stitches 27 forming a plurality of wales $W_1$ –$W_6$ (six in the illustrated embodiment) juxtaposed across the warp-knit structure. The stringer tape 25 has a pair of spaced longitudinal edge portions 29,30 and a central web portion 31 extending between the edge portions 29,30, one of the edge portions 29 being adapted to support a row of coupling elements. A plurality of warp threads 32 (three in the illustrated embodiment) are laid in a pattern of 0-0/1-1 which threads extend in and along two adjacent wales $W_5$,$W_6$ in the one edge portion or element-supporting edge portion 29 and the wale $W_4$ lying in the central web portion 31 adjacent to the wale $W_5$ for reinforcing the wales $W_4$–$W_6$, but they may be omitted.

The central web portion 31 has a coarse region 33 adjacent to the element-supporting edge portion 29 and extending longitudinally in and along an interwale groove $G_3$ between the wales $W_3$ and $W_4$ which are devoid of the tricot stitch 27 running therebetween. The relatively narrow stringer tape 25 thus constructed is suitable for use particularly in a slide fastener with coupling elements of smaller size.

Figure 3:
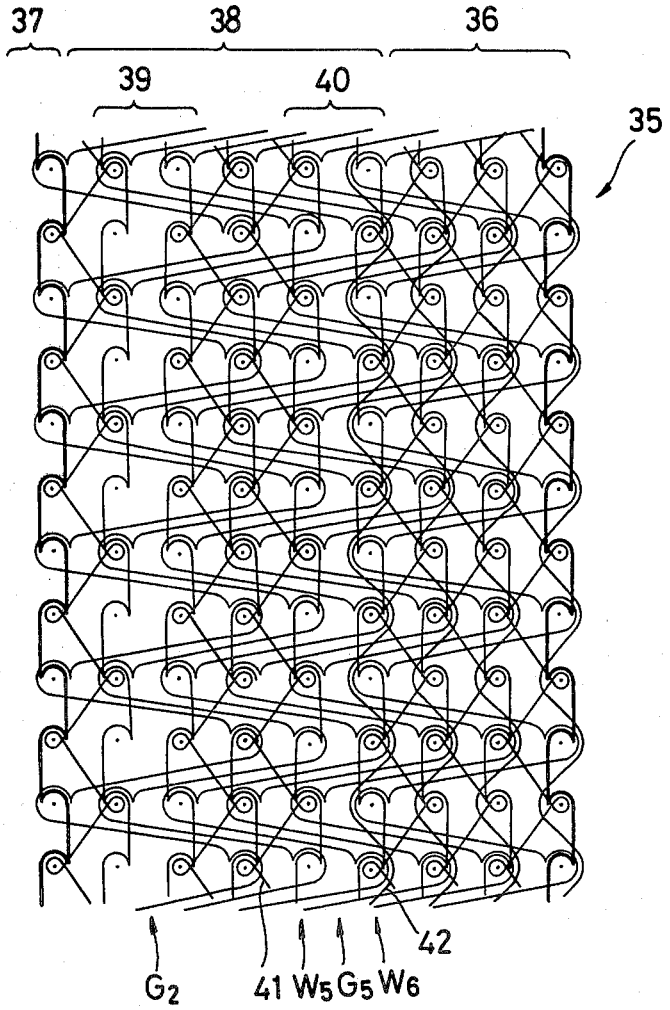

FIG. 3 shows a manifold warp-knit stringer tape 35 including a pair of spaced edge portions 36,37 and a central web portion 38 extending between the edge portions 36,37, one edge portion 36 being adapted to support a row of coupling elements. The stringer tape 35 has a warp-knit structure substantially similar to that of the stringer tape 10 of FIG. 1 except that the central web portion 38 includes a pair of spaced longitudinal coarse regions 39,40 adjacent to the edge portions 37,36 respectively, and each extending in and along one interwale groove $G_2$ ($G_5$) between two adjacent wales $W_2$,$W_3$ ($W_5$,$W_6$) which are devoid of a tricot stitch 41, and a warp thread 42 is laid, in addition to those in the one edge portion 36, in a pattern of 0-0/1-1 and extends in and along the wale $W_6$ in the central web portions 38.

To provide a plurality of longitudinal coarse regions 39,40 (two in the illustrated embodiment) is particularly useful when embodied in the attachment of a relatively wide stringer tape, such as the tape 35, stably onto a knit garment, and if not so the stringer tape 35 will turn up at one of the edge portions 36,37 thereof.

Figure 4:
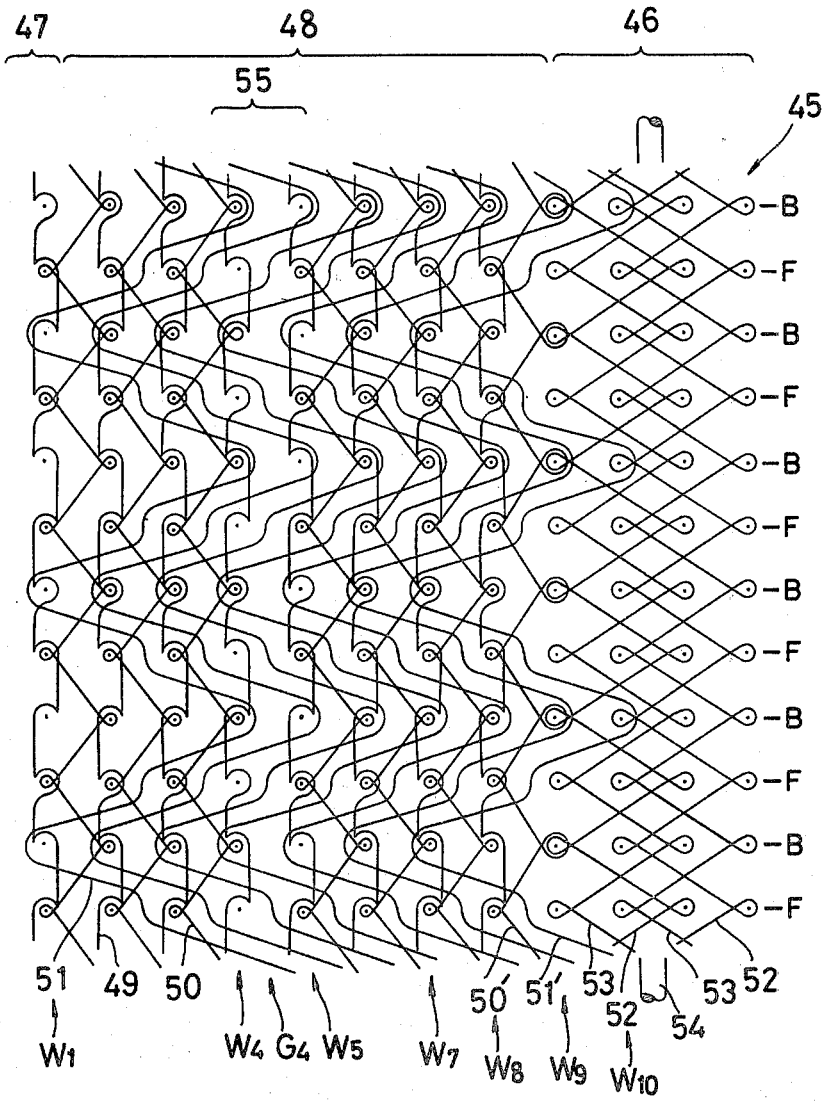

FIG. 4 illustrates a warp-knit stringer tape 45 of a double-faced structure knit on a two needle bar knitting machine, the machine having a back needle bed B and a front needle bed F, the tape including a pair of spaced marginal edge portions 46,47 extending along a pair of opposite edges of the tape 45, respectively, and a central web portion 48 extending between the edge portions 46,47, one edge portion 46 is adapted to support a row of coupling elements. The central web portion 48 and the other edge portion 47 are formed with a plurality of first threads 49 knit as chain stitches in a pattern of 2-0/0-2/0-2, a plurality of second threads 50 knit as tricot stitches in a pattern of 2-4/2-0, and a plurality of weft threads 51 laid in a pattern of 4-4/8-8/4-4/0-0, the threads 49,50 forming a plurality of wales $W_1$ to $W_9$ juxtaposed across the central web and edge portions 48,47. The element-supporting edge portion 46 is composed of a first set of single cord stitches 52 knit in a pattern of 2-0/4-6, a second set of single cord stitches 53 knit in a pattern of 4-6/2-0, and a stuffer warp 54 laid in the edge portion 46 in a pattern of 0-0/0-0. The element-supporting edge portion 46 thus formed is a bulged knit tube of substantially circular cross section surrounding the stuffer warp 54. The central web portion 48 and the element-supporting edge portion 46 are interconnected by, on one hand, the thread of a tricot stitch 50' spanning the two adjacent wales $W_8$,$W_9$ and, on the other hand, the weft laid-in thread 51' extending coursewise across four wales $W_7$–$W_{10}$ and engaging the two outermost wales $W_7$,$W_{10}$.

The two adjacent wales $W_4$,$W_5$ in the central web portion 48 are devoid of the thread of the tricot stitch 50 and shrinker loops of the tricot stitch are therefore not existent in an interwale groove $G_4$ between the wales $W_4$,$W_5$, with the result that a longitudinal coarse region 55 is formed substantially centrally in the central web portion 48. The warp-knit stringer tape 45 with the bulged tubular element-supporting portion 46 is suitable for use in a slide fastener stringer having a row of discrete coupling elements made of metal or plastic mounted on the tape edge portion 46 by clamping or injection-molding.

FIG. 5 is illustrative of a manner in which a slide fastener stringer 56 including the warp-knit stringer tape 10 shown in FIG. 1 is attached to the knit fabric 23 by the chain of thread loops 21 running along the coarse region 19. When attached to the knit fabric 23, the respective openings 20 in the coarse region 19 are substantially filled with the respective interstitches 22 of two adjacent thread loops.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A warp-knit stringer tape for slide fasteners comprising:

(a) a warp-knit structure including a longitudinal marginal edge portion adapted to support a row of coupling elements thereon, said warp-knit structure comprising:

(i) a plurality of first threads knit as chain stitches and each forming one wale, (ii) a plurality of second threads knit in a stitch pattern forming wales and each interconnecting two adjacent wales, and (iii) a plurality of third threads each extending coursewise across and interconnecting at least three wales, and (b) said warp-knit structure further including a coarse region extending longitudinally therethrough within portion other than said longitudinal marginal edge portion, said coarse region being devoid of at least one of said second threads.

2. A warp-knit stringer tape according to claim 1, said chain stitches being knit in a pattern of 1-0/0-1.

3. A warp-knit stringer tape according to claim 1, said second threads being knit as tricot stitches in a pattern of 1-2/1-0.

4. A warp-knit stringer tape according to claim 1, said third threads being knit as single cord stitches in a pattern of 0-1/4-3.

5. A warp-knit stringer tape according to claim 1, said third threads being laid in a pattern of 0-0/4-4.

6. A warp knit-stringer tape according to claim 1, comprising a second longitudinal marginal edge portion and a central web portion extending between said element-supporting edge portion and said second edge portion, and a second similar coarse region, said two coarse regions extending in said central portion adjacent to said edge portions, respectively.

7. A warp-knit stringer tape according to claim 1, said warp-knit structure comprising a double-faced fabric made on two needle bars.

* * * * *